US010808182B2

(12) United States Patent
Besnault et al.

(10) Patent No.: US 10,808,182 B2
(45) Date of Patent: Oct. 20, 2020

(54) PROCESS FOR THE REGENERATION OF AN ALKALINE SOLUTION UTILIZED IN A PROCESS FOR THE EXTRACTION OF SULPHUR-CONTAINING COMPOUNDS COMPRISING A WASHING STEP

(71) Applicant: AXENS, Rueil-Malmaison (FR)

(72) Inventors: Jean-Michel Besnault, Le Vesinet (FR); Sebastien Ferrero, Chaville (FR); Mai Phuong Do, Kuala Lumpur (MY)

(73) Assignee: AXENS, Rueil Malmaison (FR)

( * ) Notice: Subject to any disclaimer, the term of this patent is extended or adjusted under 35 U.S.C. 154(b) by 131 days.

(21) Appl. No.: 15/907,927

(22) Filed: Feb. 28, 2018

(65) Prior Publication Data

US 2018/0320089 A1 Nov. 8, 2018

(30) Foreign Application Priority Data

Mar. 1, 2017 (FR) ..... 17 51678

(51) Int. Cl.

| | |
|---|---|
| ***C10G 19/08*** | (2006.01) |
| ***C10G 19/02*** | (2006.01) |
| ***C10G 53/04*** | (2006.01) |
| ***C10G 53/12*** | (2006.01) |

(52) U.S. Cl.

CPC ..... *C10G 19/08* (2013.01); *C10G 19/02* (2013.01); *C10G 53/04* (2013.01); *C10G 53/12* (2013.01); *C10G 2300/104* (2013.01); *C10G 2300/1051* (2013.01); *C10G 2300/202* (2013.01)

(58) Field of Classification Search

CPC ..... C10G 19/08; C10G 19/02; C10G 53/12; C10G 53/04; C10G 2300/202; C10G 2300/104; C10G 2300/1051

See application file for complete search history.

(56) References Cited

U.S. PATENT DOCUMENTS

| | | | | |
|---|---|---|---|---|
| 2,988,500 A | | 6/1961 | Gleim et al. | |
| 4,626,341 A | * | 12/1986 | Verachtert ..... | C10G 19/08 208/235 |
| 4,666,689 A | * | 5/1987 | Maple ..... | C10G 19/08 208/235 |

(Continued)

FOREIGN PATENT DOCUMENTS

| | | |
|---|---|---|
| FR | 1254713 A | 2/1961 |
| FR | 1249134 A | 3/1961 |
| WO | 2005121279 A1 | 12/2005 |

OTHER PUBLICATIONS

Search Report for Related French Application No. 1751678 dated Sep. 29, 2017.

*Primary Examiner* — Brian A McCaig

(74) *Attorney, Agent, or Firm* — Millen White Zelano and Branigan, PC; John Sopp

(57) ABSTRACT

The present invention relates to the field of the extraction of sulphur-containing compounds such as the mercaptans, COS or $H_2S$ from a hydrocarbon-containing cut. This selective extraction is carried out by bringing the hydrocarbon-containing cut in liquid phase into contact with an alkaline solution, for example soda. The process according to the invention is an improved process for the regeneration of the alkaline solution, making it possible to reduce the quantity of alkaline solution required in the regeneration section.

11 Claims, 4 Drawing Sheets

(56) References Cited

U.S. PATENT DOCUMENTS

| | | | | |
|---|---|---|---|---|
| 5,354,482 | A * | 10/1994 | Varadi | C02F 1/74 210/742 |
| 5,395,517 | A | 3/1995 | Varadi et al. | |
| 7,951,988 | B2 * | 5/2011 | Foster | C02F 11/06 210/761 |
| 2003/0072707 | A1 | 4/2003 | Ray et al. | |
| 2014/0284250 | A1 | 9/2014 | Augier et al. | |

* cited by examiner

PROCESS FOR THE REGENERATION OF AN ALKALINE SOLUTION UTILIZED IN A PROCESS FOR THE EXTRACTION OF SULPHUR-CONTAINING COMPOUNDS COMPRISING A WASHING STEP

CONTEXT OF THE INVENTION

The invention relates to the field of the extraction of sulphur-containing compounds such as the mercaptans, COS, $H_2S$ or $CS_2$ from a hydrocarbon-containing cut. This selective extraction is carried out by bringing the hydrocarbon-containing cut in liquid phase into contact with an alkaline solution, for example soda, in order to form mercaptide-type species and salts. After extraction, the alkaline solution loaded with mercaptides is regenerated.

The regeneration of the alkaline solution consists of an exothermic oxidation reaction in the presence of a catalyst converting the mercaptide-type species to disulphides. Said disulphides constitute a hydrocarbon phase which is not very soluble in the alkaline solution. Separation of the reactor effluents produces on the one hand a partially regenerated alkaline solution, and on the other hand a hydrocarbon phase rich in disulphides.

The partially regenerated alkaline solution can be reused directly in the extraction section, or can be treated in order to extract therefrom the residual disulphides that it contains before being reintroduced into the extractor.

The process according to the invention consists of improving the process for the regeneration of the alkaline solution, by reducing the excess of alkaline solution used to control the rise in temperature due to the oxidation reaction. The process according to the invention thus makes it possible to reduce the quantity of alkaline solution in the regeneration section and therefore to reduce the investment, the operating costs, the inventory of alkaline solution and of catalyst in the regeneration section. Finally, the process according to the invention makes it possible to increase the energy efficiency of the process.

The processes for removing the mercaptans are used in refining for the hydrocarbon-containing cuts essentially comprising light cuts ranging from methane to the kerosene cut in order to convert them to upgradable products. In fact, the presence of mercaptans makes the hydrocarbon odorous and unstable with a tendency to form hydrogen sulphide. Mercaptans occur in a large number of hydrocarbon-containing feedstocks, among which the following may be mentioned: feedstocks originating from the distillation of crude oil, for example LPG, naphtha, gasolines or kerosene, or feedstocks originating from the extraction of gas from fields or the extraction of shale oil. Moreover, the feedstocks concerned can also originate from a cracking unit. This list is not exhaustive.

EXAMINATION OF THE PRIOR ART

Figure 1:
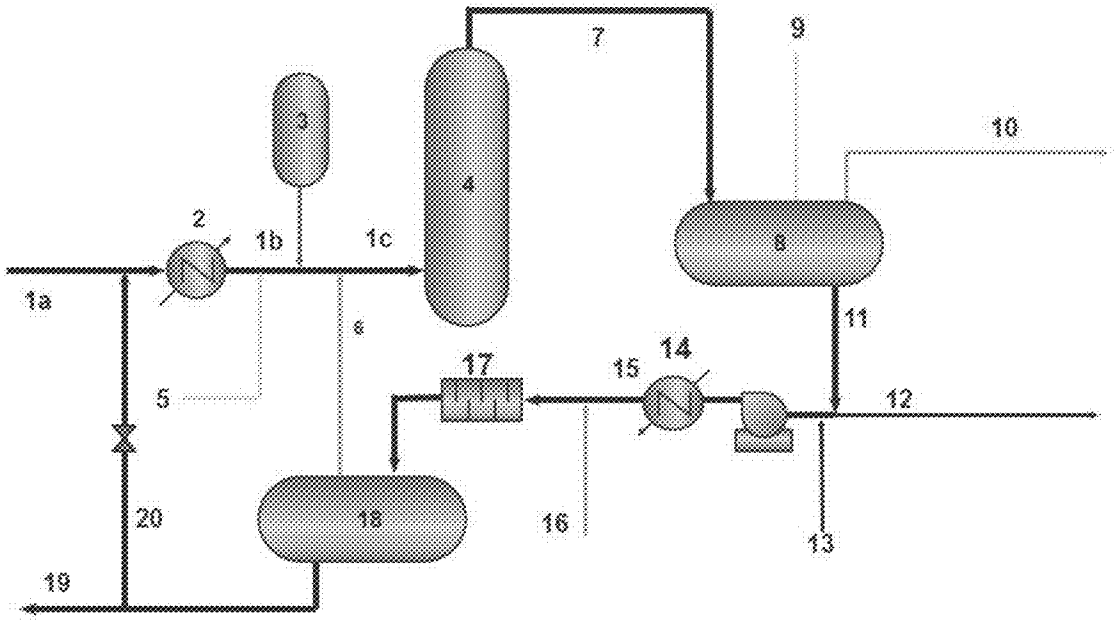
FIG. 1 represents the diagram of the regeneration section of the used alkaline solution originating from the extraction section of the sulphur-containing compounds according to the prior art.

The extraction of sulphur-containing compounds from a hydrocarbon cut (gasoline, LPG etc.) by liquid-liquid extraction with an alkaline solution is well known in the state of the art. When the majority of the sulphur-containing species are mercaptans, or thiols, a type of process that is used very widely consists of carrying out an extraction, preferably countercurrent, of the sulphur-containing species by means of an aqueous alkaline solution, generally soda, circulating in a loop in the process, as described in the U.S. Pat. No. 4,081,354.

The alkaline solution leaving the extraction section is called alkaline solution enriched with sulphur-containing compounds and is sent to the regeneration section. In the remainder of the text it is called alkaline solution to be regenerated or used alkaline solution.

In the regeneration section, the alkaline solution to be regenerated is brought into contact in the oxidation reactor with an oxidizing agent, generally air or pure oxygen, or an oxidizing gas, in the presence of a dissolved catalyst, for example based on cobalt phthalocyanine in order to convert the mercaptide-type species to disulphides.

The mercaptides can generally be defined as mercaptan salts containing the RS-ion, where R is an alkyl or aryl group.

The parameters associated with the oxidation reaction are chosen so as to oxidize almost all of the mercaptides present in the alkaline solution to disulphides which are not very soluble in the alkaline phase. Optionally, the alkaline solution can be brought into contact simultaneously in the oxidation reactor with a hydrocarbon-containing cut, in which the disulphides formed by the reaction dissolve.

The oxidation reaction is exothermic and the temperature of the process fluid in the oxidation reactor must be controlled. In the processes according to the prior art, the cooling means used is a line allowing recirculation of at least a part of the regenerated alkaline solution from the outlet of the regeneration section to the inlet of the regeneration section, i.e. entirely bypassing the extraction section. Thus an excess of regenerated alkaline solution supplies the oxidation reactor and is used in order to absorb a part of the heat given off by the oxidation reaction, which makes it possible to control the rise in temperature in the oxidation reactor.

In the remainder of the text, the quantity of alkaline solution used to control the rise in temperature in the reactor will be called "excess of alkaline solution" and optionally, "excess of recirculated alkaline solution" when the alkaline solution used to control the rise in temperature of the reactor originates from a recirculation line inside the regeneration section.

When the content of sulphur-containing compounds in the feedstock increases, the excess of alkaline solution used in order to absorb the calories given off by the oxidation reaction increases and becomes relatively significant compared to the quantity of used alkaline solution originating from the extraction.

The excess of alkaline solution used in the oxidation reactor has an impact on the total quantity of alkaline solution circulating in the regeneration section, and in particular in the washing section. This total quantity influences the inventory of alkaline solution in the regeneration section, therefore the cost of investments and the cost of operations.

The U.S. Pat. No. 9,422,483 proposes replacing the washing with a hydrocarbon, the last optional step of the regeneration of the alkaline solution to be regenerated, with an extraction step in an extraction column bringing into contact a hydrocarbon different from the feedstock to be treated, followed by a step of oxidation of the disulphides. This patent discloses an alternative solution to the washing with a hydrocarbon.

None of the documents of the prior art discloses a solution making it possible to reduce the excess of regenerated alkaline solution, while retaining an identical exothermicity in the oxidation reactor.

The invention differs from the prior art in that:

- the flow rate of alkaline solution in the regeneration section is reduced compared with the prior art
- the size of the items of equipment is reduced, the investment is minimized and the energy performance of the process improved.
- the quantity of hydrocarbon-containing cut necessary for the washing section of the alkaline solution is reduced, which reduces the consumption of this cut and the impact on the downstream unit which re-treats it once loaded with sulphur-containing compounds.
- the inventory of alkaline solution of the unit is reduced, which reduces the consumption and the purge of alkaline solution during the transitional phases for example, starting and stopping the unit.
- the inventory of catalyst of the unit is reduced, which reduces the consumption and the purge of catalyst during the transitional phases for example, starting and stopping the unit.
- According to the variants of the invention, control of the exothermicity in the oxidation reactor is improved.

BRIEF DESCRIPTION OF THE INVENTION

The principle of the present invention consists of improving the process for regeneration of the alkaline solution, by reducing the excess of recirculated alkaline solution, while retaining an identical exothermicity in the oxidation reactor of said regeneration section.

According to the invention, an excess of recirculated alkaline solution constituted by partially regenerated alkaline solution is preferentially used as cooling means for controlling the temperature of the oxidation reactor. Said partially regenerated solution is depleted of mercaptides, but contains residual disulphides. For example, it can be alkaline solution as it leaves the oxidation reactor, after separation of the hydrocarbon phase rich in disulphides and cooling.

In fact, at the outlet of the oxidation reactor, the alkaline phase is separated from the hydrocarbon phase rich in disulphide. Said phase is constituted either by disulphides only, or by a hydrocarbon-containing cut rich in disulphides, if a hydrocarbon-containing cut has been simultaneously injected into the oxidation reactor leading to the dissolution of the disulphides in this cut.

The alkaline solution, originating from the separation, no longer contains mercaptides but residual disulphides of the order of 200 ppm (by weight). It is called partially regenerated alkaline solution, or, in the case where the alkaline solution is soda, partially regenerated soda.

After separation, said partially regenerated alkaline solution is cooled then subjected to a treatment making it possible to reduce the residual disulphides content thereof.

This treatment typically consists of being brought into contact with a hydrocarbon-containing cut not containing sulphur-containing compounds, typically a desulphurized hydrocarbon such as a naphtha cut or a desulphurized gasoline cut. The mixture obtained is then separated into a hydrocarbon phase and an aqueous phase in a washing drum or an equivalent means of separation. The aqueous phase constitutes the totally regenerated alkaline solution and the hydrocarbon phase is a hydrocarbon-containing cut, partially enriched with sulphur-containing compounds, which can be sent to the oxidation reactor.

The section implementing said treatment is typically called the washing section.

The alkaline solution leaving the regeneration section is called regenerated alkaline solution or alkaline solution depleted of sulphur-containing compounds ("lean caustic"). In the remainder of the text it will be called regenerated alkaline solution, or more precisely, totally regenerated alkaline solution.

According to the invention, the excess of partially regenerated alkaline solution recirculated to the oxidation reactor (4) in order to control the rise in temperature, is generally available at a temperature less than or equal to 45° C., typically between 10° and 45° C., preferentially between 35° C. and 45° C., downstream of the cooling means (14), typically an exchanger.

In general, the purge of partially regenerated alkaline solution and the addition of corresponding fresh alkaline solution are carried out upstream of the cooling (14). This addition and this purge can be either continuous or intermittent. The excess of recirculated alkaline solution can therefore also be a mixture of fresh alkaline solution and partially regenerated alkaline solution.

According to a first variant of the invention, an excess of recirculated alkaline solution (21*a*) is sent to the oxidation reactor, via the circuit supplying the reactor, either upstream of the preheating exchanger (2) of the alkaline solution to be regenerated in the pipe (1*a*) leaving the extraction section, or downstream (1*b*) and (1*c*) of the exchanger (2). The excess of recirculated alkaline solution is therefore sent to the oxidation reactor in a mixture with the used alkaline solution to be regenerated.

According to this first variant, the total quantity of alkaline solution present in the oxidation reactor (4) is reduced compared with the prior art, as well as the inventory of alkaline solution in all of the regeneration section. In addition, the washing section only treats the alkaline solution that must be used in the extraction section and therefore the size and operating costs thereof will be reduced.

According to a second variant of the invention, an excess of alkaline solution (22*a*) is sent to the oxidation reactor (4), directly to one or more points of said reactor.

Each injection point can advantageously be equipped with a distribution device, such as an injection nozzle, or optionally a mixing device, of the quench box type. A distribution device makes it possible to homogeneously distribute the excess of alkaline solution in the reactor. Moreover, a mixing device will make it possible to mix the excess of alkaline solution and the flow contained in the reactor. Each injection point can be provided with another type of equivalent device. The oxidation reactor can be provided with one or more thermocouples or with any equivalent means for measuring the temperature, in order to adjust the flow rate or the flow rates of excess alkaline solution to be introduced at each of the injection points, according to a law making it possible to control the rise in temperature in the reactor.

The flow rate of the injection of recirculated alkaline solution can be controlled by using the temperature measurements situated upstream and downstream of the oxidation reactor.

According to this variant of the invention, the excess of alkaline solution injected into the reactor can originate from a recirculation of alkaline solution or from a flow originating outside of the regeneration section.

According to a third variant of the invention, the oxidation reactor is provided with an additional cooling means, typically an item of equipment (23), making it possible to directly cool the flow in circulation in the oxidation reactor (4) so as to further reduce the excess of alkaline solution used.

This item of equipment (23) can typically be an exchanger or any equivalent means, for example, a lateral exchanger, a pin or a coil installed in the reactor, a circulating reflux, a double jacket around the reactor. This list is not exhaustive. The cooling fluid can be a flow inside the unit, or a flow outside the unit or a cold utility, for example water, or a specific coolant fluid. This third variant is compatible with the first and the second variant of the present invention.

According to another variant of the invention, the excess of recirculated alkaline solution can be cooled, by an additional cooling means such as an additional exchanger or any other equivalent item of equipment, to a temperature at least 5° C. less than that of the cooled partially regenerated alkaline solution (15), typically to a temperature comprised between 10° C. and 40° C., preferentially between 10° C. and 35° C.

Finally, according to another variant of the invention, the excess of alkaline solution is replaced by a supply of an excess of oxidizing agent, for example air or oxygen upstream or directly into the oxidation reactor (4) via at least one injection point.

The different variants of the invention can be combined during the design of the unit. They can be operated simultaneously or alternately. Thus, the unit can be provided, on the one hand, with a recirculation line making it possible to send an excess of recirculated alkaline solution into the circuit upstream of the oxidation reactor and, on the other hand, with a recirculation line making it possible to send an excess of recirculated alkaline solution to one or more points of the oxidation reactor. Whatever the variant of the invention, the oxidation reactor (4) can be provided with a cooling means (23).

According to the invention, for an identical rise in temperature in the oxidation reactor, the excess of alkaline solution in the regeneration section is reduced compared with the prior art, which makes it possible to minimize the investment necessary for the construction of these units, and to improve the energy efficiency of the process and therefore the corresponding operating costs.

The invention can be advantageously used within the context of a "debottlenecking" of a unit, i.e. an increase in its production capacity.

In summary the invention can be defined as a process for the regeneration of a used alkaline solution utilized in a unit for the extraction of the sulphur-containing compounds from a hydrocarbon-containing cut, comprising the sequence of following steps:

a) Sending the used alkaline solution (1*a*) into an oxidation reactor (4) in which it is brought into contact with an oxidizing agent (5) and a catalyst (3), said used alkaline solution being heated to a temperature comprised between 40° C. and 50° C. beforehand, using an exchanger (2).

b) Sending the effluents (7) of the oxidation reactor (4) into a separator (8) from which a hydrocarbon phase rich in disulphides (10), and a partially regenerated alkaline solution (11) are extracted, c) Cooling the partially regenerated alkaline solution (11) originating from step b) to a temperature less than or equal to 45° C., d) Dividing the partially regenerated alkaline solution (15) cooled in step c) into two flows:

- a flow constituting the excess of recirculated alkaline solution which is sent upstream (21*a*), or directly (21*b*), into the oxidation reactor (4), and which constitutes the cooling means used to control the rise in temperature of said reactor, and,
- a flow (21*b*) or (22*b*) which continues the regeneration process, e) Mixing the flow (21*b*) or (22*b*), originating from step d) with a hydrocarbon-containing cut without sulphur-containing compounds (16), f) Sending the mixture originating from step e) into a separator (18) from which a totally regenerated alkaline solution (19), and a hydrocarbon-containing cut partially enriched with disulphides (6) are extracted.

According to a first preferred variant of the regeneration process according to the invention, the excess (21*a*) of recirculated alkaline solution is sent to the oxidation reactor (4), via the circuit upstream of said oxidation reactor (4), in a mixture with the used alkaline solution (1*a*).

According to another preferred variant of the regeneration process according to the invention, the excess (22*a*) of recirculated alkaline solution is sent to the oxidation reactor (4), directly to one or more points of said oxidation reactor (4).

According to another preferred variant of the regeneration process according to the invention, the point or points of introduction of the excess of recirculated alkaline solution into the oxidation reactor (4) are provided with a diffusion means or with a mixing means.

According to another preferred variant of the regeneration process according to the invention, the point or points of introduction of the excess of recirculated alkaline solution into the oxidation reactor (4) are positioned so as to allow control of the rise in temperature of the oxidation reactor (4).

Generally, the catalyst employed in the oxidation reactor is of the cobalt- or vanadium-phthalocyanine type.

Generally, the catalyst employed in the oxidation reactor is added into the alkaline solution at the inlet of the oxidation reactor so as to achieve a concentration of catalyst in the alkaline solution comprised between 10 and 1,000 ppm by weight, preferentially comprised between 10 and 500 ppm by weight.

According to another preferred variant of the regeneration process according to the invention, the oxidation reactor (4) is equipped with a cooling means (23).

According to another preferred variant of the regeneration process according to the invention, the excess of recirculated alkaline solution (21*a*) or (22*a*) is cooled to a temperature at least 5° C. less than that of the partially regenerated alkaline solution, before being sent to the oxidation reactor (4).

In the regeneration process according to the present invention, the hydrocarbon-containing cut treated in the unit for the extraction of the sulphur-containing compounds can generally range from methane to kerosene.

The installation for the regeneration of a used alkaline solution utilized in a unit for the extraction of the sulphur-containing compounds from a hydrocarbon-containing cut, according to the invention, comprises at least:

an item of equipment (2) making it possible to heat the used alkaline solution, before its introduction into the oxidation reactor, to a temperature comprised between 40° C. and 50° C., an oxidation reactor (4), in which the used alkaline solution is brought into contact with an oxidizing agent (5) and a catalyst (3), a separator (8) supplied by the effluent originating from the oxidation reactor (4), from which a hydrocarbon phase rich in disulphides (10), and a partially regenerated alkaline solution (11) are extracted, a cooling means (14) making it possible to cool the partially regenerated alkaline solution (11) originating from the separator to a temperature less than or equal to 45° C.

a means making it possible to divide the cooled partially regenerated alkaline solution (15) into two flows:

a flow constituting the excess of recirculated alkaline solution which is sent upstream (21*a*), or directly (22*a*), into the oxidation reactor (4), and, a flow (21*b*) or (22*b*) which continues the regeneration process a cooling means constituted by the excess of recirculated alkaline solution which is sent upstream (21*a*), or directly (22*a*), into the oxidation reactor (4), a means of mixing the flow (21*b*) or (22*b*), with a hydrocarbon-containing cut without sulphur-containing compounds (16), a separator (18) supplied with the mixture, from which a totally regenerated alkaline solution (19), and a hydrocarbon-containing cut partially enriched with disulphides (6) are extracted.

According to a first preferred variant of the installation for the regeneration of used alkaline solution according to the invention, the oxidation reactor is equipped with an additional cooling means (23).

According to another preferred variant of the installation for the regeneration of used alkaline solution according to the invention, an additional cooling means makes it possible to cool the excess of recirculated alkaline solution (21*a*) or (22*a*) to a temperature at least 5° C. lower than that of the partially regenerated cooled alkaline solution (15).

DETAILED DESCRIPTION OF THE INVENTION

The present invention relates to a process for the extraction of sulphur-containing compounds present in a hydrocarbon cut, in the case where the majority sulphur-containing species are mercaptans, denoted RSH, for example methanethiol $CH_3SH$, ethanethiol $C_2H_5SH$, propanethiol $C_3H_7SH$, and where other sulphur-containing species can be also present, such as hydrogen sulphide H2S or carbon oxisulphide COS.

The feedstock of used alkaline solution to be treated is supplied continuously to the regeneration section and sent continuously to the extraction section. It can optionally originate from distinct different extraction sections and return to them after regeneration. In the regeneration section, the alkaline solution is supplied and purged either discontinuously (batch or discontinuous process) or continuously (continuous process) in order to maintain the constant quality thereof.

This part of the description provides information on the extraction section which is not the subject-matter of the present invention, but allows a better understanding of it.

The feedstock to be treated, comprising the sulphur-containing compounds, can first enter a pretreatment section constituted for example by a pretreatment enclosure prefilled with an alkaline solution, typically soda diluted to a concentration comprised between 2 and 10% by weight.

The alkaline solution in the pretreatment enclosure is renewed according to an operating cycle comprised between 3 and 30 days, as a function of the age of the solution. The pretreatment extracts a variable quantity of sulphur-containing species, including mercaptans. Depending on the units, it is possible to have different pretreatment plans with, for example, at least two pretreatments operating in parallel or also a system of continuous addition and purge over this section. This list is not exhaustive.

The hydrocarbon-containing feedstock then enters an extraction section, in a standard fashion a countercurrent extraction column. The hydrocarbon-containing cut is supplied at the bottom of the column. Said extraction column is also supplied with a regenerated alkaline solution, typically soda, at the top of the column. The soda concentration is then comprised between 5% and 25% by weight, preferentially between 13 and 17% by weight. The alkaline solution can also contain polar organic solvents, for example of the dialkyl sulphoxide, amino-alcohol, amino-hydroxy-alkyl ether, alkylamine, alkylpolyamine, and alkylamide type, alone or in a mixture. The alkaline solution can contain, more generally, hydroxides of alkali metals, but also hydroxides of alkaline-earth metals and weak bases.

The function of the extraction section is to extract the majority of the mercaptans present in the hydrocarbon feedstock. In fact, the mercaptans form mercaptides in the presence of the alkaline solution which preferentially dissolve in the aqueous alkaline solution and are as a result extracted from the hydrocarbon feedstock. The hydrocarbon feedstock thus refined leaves the column at the top of the column.

The alkaline solution leaving the extraction section is loaded with mercaptides, for example with species of the sodium thiolates Na—RS type, corresponding to the mercaptans extracted, dissociated and recombined with the sodium Na+ ions if the alkaline solution is soda.

Oxidation of the alkaline solution loaded with mercaptides leaving the extraction can be carried out in different types of equipment called oxidation reactor. Said reactor is generally a vertical drum supplied via the bottom, designed so as to bring the oxidizing agent, generally gaseous, into contact with the alkaline solution loaded with mercaptides in liquid phase, and optionally with a hydrocarbon phase, also in liquid phase.

The technology often encountered for the oxidation reactor is that of a packing column, for example with Raschig rings or with Pall rings or other types of packing. The oxidation reaction is exothermic and the temperature of the process fluid in the oxidation reactor must be controlled. In fact, a minimum temperature is necessary for the oxidation reaction to be initiated. However, the temperature of the process must be controlled so as to keep it within the optimum operating range.

Figure 2:
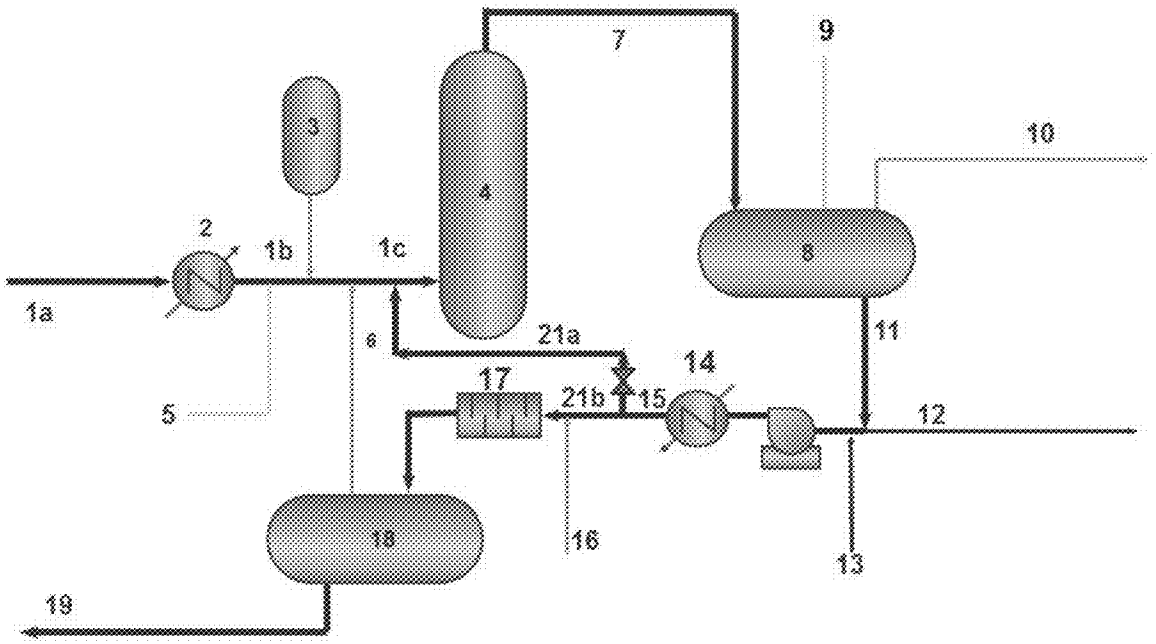
FIG. 2 represents the diagram of the regeneration section of the used alkaline solution originating from the extraction section according to the invention in a first variant.
Figure 3:
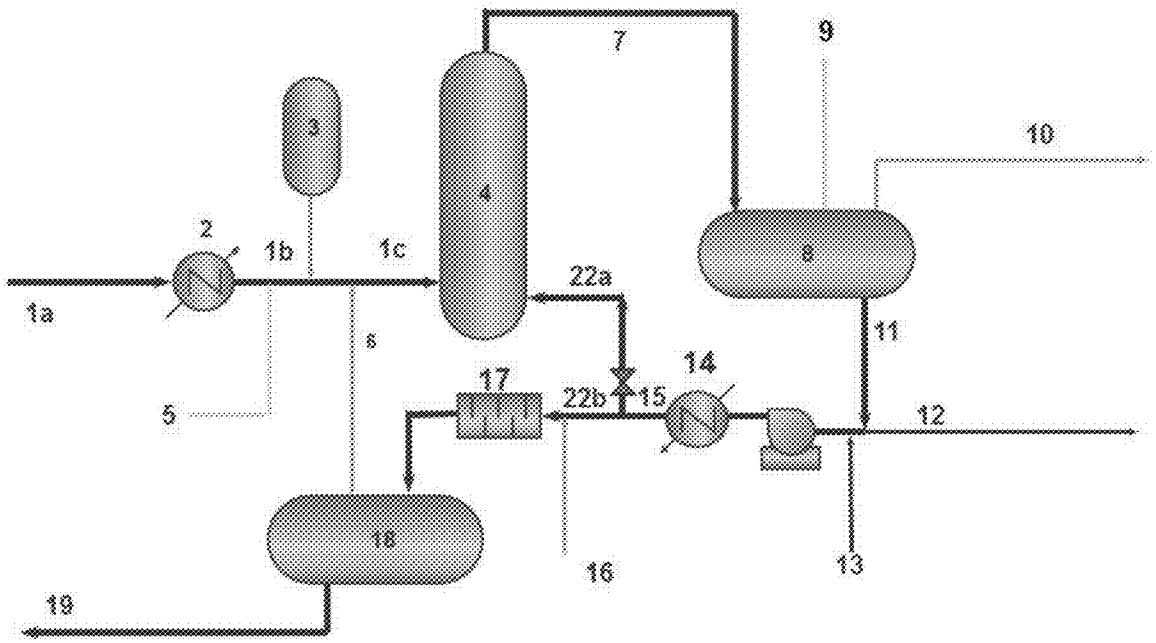
FIG. 3 represents the diagram of the regeneration section of the used alkaline solution originating from the extraction section according to the invention in a second variant.
Figure 4:
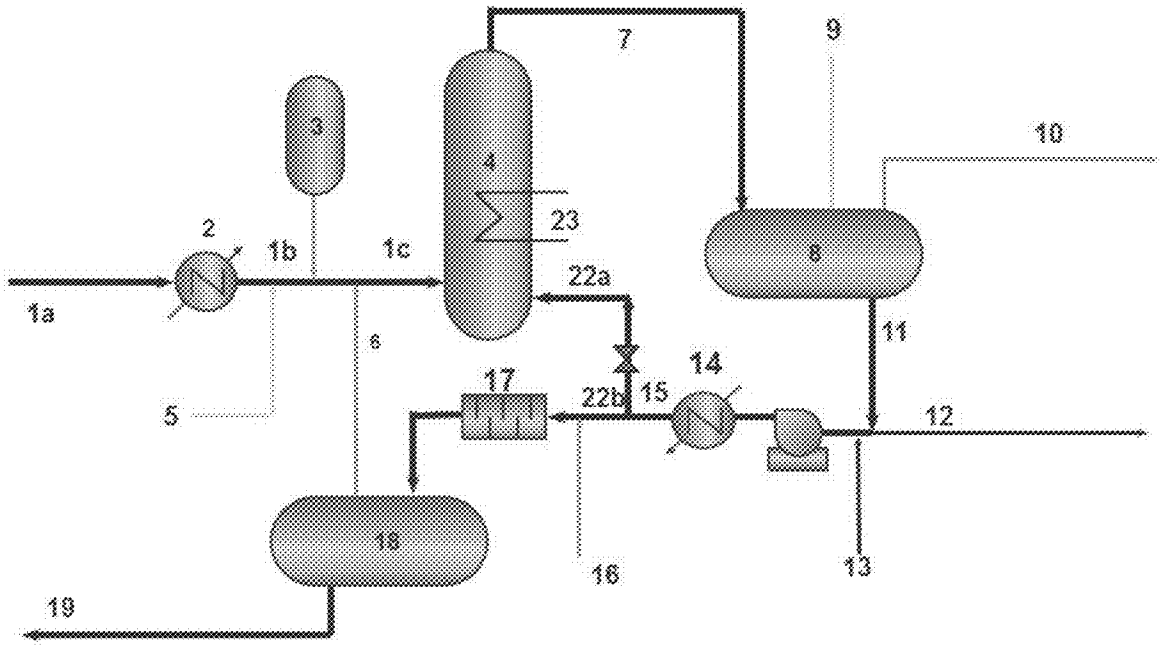
FIG. 4 represents the diagram of the regeneration section of the used alkaline solution originating from the extraction section according to the invention in a third variant.

The attached figures are diagrams of the regeneration section according to the prior art (FIG. 1) and according to the invention in its different variants (FIGS. 2, 3 and 4).

The flows or items of equipment that have the same meaning in the prior art and according to the present invention have the same number.

FIG. 1 shows the diagram of the regeneration section according to the prior art.

The flow of alkaline solution to be regenerated (1*a*) is typically heated to between 40 and 50° C., and preferentially between 42 and 47° C. in an exchanger (2), generally with process steam, or in an equivalent item of equipment, before the addition of air via the pipe (5) and of catalyst via the pipe (3) then the flow (1*c*) enters an oxidation reactor (4). The presence of a catalyst dissolved (3) in the alkaline solution promotes the oxidation reaction of the mercaptides to disulphides denoted RSSR'. The catalyst used can be from the family of phthalocyanines. The phthalocyanines of metals such as cobalt, iron, manganese, molybdenum or vanadium can be employed.

Preferentially, the phthalocyanines of cobalt or vanadium are used. As the metallic phthalocyanines are not soluble in the aqueous medium, the sulphonated derivatives thereof such as phthalocyanine trisulphonate or tetrasulphonate are generally used in the oxidation reactor.

Other catalysts can also be used. The catalyst is added to the alkaline solution at the inlet of the oxidation reactor so as to achieve a concentration of catalyst in the alkaline solution comprised between 10 and 1,000 ppm by weight, preferentially between 10 and 500 ppm by weight. The disulphides are insoluble in the alkaline phase. The hydrocarbon-containing flow originating from the washing drum (18) is injected into the used alkaline solution, for example upstream of the oxidation reactor (4), via the pipe (6) into the flow (1*b*). This hydrocarbon-containing flow concentrates the disulphides produced during the oxidation reaction.

The pressure at the top of the oxidation reactor is comprised between 0.1 and 1.0 MPa, preferably between 0.45 and 0.65 MPa.

The polyphasic medium leaving the oxidation reactor (4) via the pipe (7) is sent to a disulphide separator drum (8). The separator drum (8) can be replaced by any physical means of separation between a gas phase, a hydrocarbon phase and an aqueous phase. In said drum, the following are separated: a gas phase, a hydrocarbon phase rich in sulphur-containing species of disulphide type which is purged via the pipe (10), and a partially regenerated alkaline solution phase (11) containing a quantity of residual disulphides, typically of the order of 200 ppm by weight. The excess oxidizing agent depleted of oxygen leaves the separator drum (8) via the pipe (9).

A part of the partially regenerated alkaline solution (11) is purged via the pipe (12) in order to keep the concentration of the alkaline solution constant so as to maintain the quality of the extraction. In fact, a part of the alkaline solution is consumed by side reactions producing in particular salts, for example the salts $Na_2CO_3$ and $Na_2S$. The addition of corresponding fresh alkaline solution is carried out via the pipe (13).

After purge and addition, the partially regenerated alkaline solution is then cooled by a cooling means (14), typically an exchanger operating with cooling water or an equivalent item of equipment, such as, for example, an air-cooled exchanger or an exchanger using a coolant other than industrial water, at a temperature less than or equal to 45° C., preferentially comprised between 35° C. and 45° C., then it is sent to the washing section.

The washing section then treats the cooled partially regenerated alkaline solution (15) in order to extract the residual disulphides. In a standard fashion said section is constituted by an injection of a hydrocarbon-containing cut (16) not containing sulphur-containing compounds, generally a naphtha-type hydrocarbon or a gasoline cut having been desulphurized beforehand. Optionally, an in-line mixer (17) makes it possible to bring the partially regenerated alkaline solution and the clean hydrocarbon (16) into good contact. Then, the two fluids are separated in a separator drum called a washing drum (18). Said washing drum can be replaced by any physical means of separation between a hydrocarbon phase and an aqueous phase. The totally regenerated alkaline solution (19) can be sent to the extraction section, and the hydrocarbon-containing cut partially enriched with disulphides can be sent to the supply of the oxidation reactor via line (6). Depending on the units, it is possible to have different plans for the washing section with, for example, several washing sections operating in series.

The totally regenerated alkaline solution leaving the washing section is divided into two flows:

- a flow (19) which can be sent to the extraction section, and
- a flow (20) which is sent to the inlet of the regeneration section, i.e. completely bypassing the extraction section.

The flow (20) constitutes an excess of totally regenerated alkaline solution which supplies the oxidation reactor and which is used as cooling means in order to absorb part of the heat given off by the oxidation reaction, and makes it possible to control the rise in temperature in said reactor.

FIG. 2 shows a first variant of the process according to the invention. The process according to the invention eliminates the recirculation line for the totally regenerated alkaline solution (20) the starting point of which in the prior art is situated, at the outlet of the regeneration section, downstream of the washing drum (18) according to FIG. 1. According to the invention, the excess of recirculated alkaline solution, constituted by cooled partially regenerated alkaline solution (15), is removed, downstream of the exchanger (14) and upstream of the washing drum (18). Said excess is sent to the oxidation reactor (4), in a mixture with the flow of used alkaline solution, via the new recirculation line (21*a*). That is to say said new recirculation line (21*a*) makes it possible to inject the excess alkaline solution into the circuit upstream of the oxidation reactor (4). The arrival point of said line can also be placed upstream of the preheating exchanger (2) in the pipe (1*a*) or downstream of it in the pipes (1*b*) and (1*c*). The flow rate in this line (21*a*) is adjusted as a function of the increase in temperature in the oxidation reactor (4), in order to control the rise in temperature therein.

FIG. 3 shows a variant of the present invention in which the line (21*a*) for the recirculation of the partially regenerated alkaline solution is replaced by a line (22*a*) performing the same role, i.e. sending an excess of recirculated alkaline solution to the oxidation reactor (4) in order to control its rise in temperature, and with the same departure point, but the arrival point of which is situated in the oxidation reactor (4) itself at one or more arrival points. In the case where several introduction points are used, the flow rate of excess recirculated alkaline solution can optionally be varied in each of the points according to a law making it possible to control the rise in temperature throughout the oxidation reactor (4).

FIG. 4 shows a variant of the present invention which also makes it possible to a reduce the excess of recirculated alkaline solution used in order to control the temperature in the oxidation reactor (4). In fact, by equipping this reactor with an additional cooling means, such as an exchanger (23) or any other equivalent means, the flow rate of excess recirculated alkaline solution sent to the oxidation reactor (4) via the line (22*a*), or upstream of the reactor (4) via the line (21*a*), can also be reduced according to the variant chosen.

EXAMPLES ACCORDING TO THE INVENTION

The invention will be better understood on reading the following comparative examples. A unit is considered for the extraction of mercaptans present in a hydrocarbon phase of LPG type, a mixture of alkanes with 2, 3, 4 and 5 carbon atoms. The alkaline solution employed for carrying out this extraction is constituted by soda. The hydrocarbon feedstock to be treated originates from a unit for the distillation of condensates.

It has a flow rate of 13.2 t/h and the composition given in Table 1 below:

TABLE 1

Properties of the feedstock

| Properties | % by weight |
|---|---|
| Ethane, % by weight | 0.3 |
| Propane, % by weight | 18.3 |
| Butane, % by weight | 77.2 |
| Pentane, % by weight | 2.2 |
| Impurities | |
| $H_2S$, ppm by weight | 50 00 |
| COS ppm by weight | 225 |
| methyl mercaptans, ppm by weight | 90 00 |
| ethyl mercaptans, ppm by weight | 56 25 |
| propyl mercaptans, ppm by weight | 150 |

It will be considered for the examples that the feedstock, before the extraction section, passes into a section called prewashing that makes it possible to totally remove the H2S and the COS.

In the washing section and in the oxidation reactor, a hydrocarbon-containing cut is used constituted by a cut of desulphurized naphtha type the properties of which are given in Table 2 below:

TABLE 2

Properties of the hydrocarbon-containing cut used in the washing section

| TBP | ° C. |
|---|---|
| Temp. of initial boiling | 50 |
| 5 | 74 |
| 10 | 80 |
| 30 | 103 |
| 50 | 118 |
| 70 | 136 |
| 90 | 162 |
| 95 | 175 |
| Temp. of final boiling | 198 |
| Molecular weight, kg/kmol | 110.6 |
| Density, kg/m$^3$ | 730 |
| Total sulphur, ppm by weight | <5 |

For all the examples, the flow rate of regenerated soda (19) which supplies the extraction section is 3.9 t/h with a soda content of 15% by weight and at a temperature of 40° C. After reaction with the sulphur-containing compounds, the used soda (1*a*) i.e. enriched with sulphur-containing compounds, obtained at the outlet of the extraction section (therefore at the inlet of the regeneration section) has a soda content of 10.7% by weight and a flow rate of 4.1 t/h.

For all the examples, the consumption of fresh soda (13) is zero, and the quantity of purged partially regenerated soda (12) is also zero (intermittent purge-addition operation).

Example 1

This example is according to the prior art. The process according to the prior art is represented by the diagram in FIG. 1.

An excess of recirculated soda of 9.1 t/h constituted by totally regenerated soda at 40° C. bypassing the extraction section via the line (20) is used in order to control the rise in temperature in the reactor and to obtain a temperature difference of 9° C. between the inlet and the outlet of the oxidation reactor (4).

The excess of soda bypassing the extraction section via the line (20) is mixed with the used soda originating from the extraction section (1*a*). The mixture is then heated to 45° C. in an exchanger (2) before the addition of air via the line (5) (0.2 t/h) and of catalyst (3) then it enters the oxidation reactor (4). The quantity of catalyst injected aims to maintain a concentration of catalyst of 250 ppm by weight in the alkaline solution which goes into the reactor.

The oxidation reactor (4) operates at 0.59 MPa, at the top of the reactor. At the outlet of the oxidation reactor, the soda no longer contains sodium thiolates and is saturated with dissolved oxygen.

The exchanger (2) serving to heat the mixture of used soda and totally regenerated alkaline solution to 45° C. consumes 70 kW and the exchanger (14) for cooling the partially regenerated soda, serving to cool it from 54° C. to 40° C., consumes 200 kW.

The flow rate of the hydrocarbon-containing cut injected via the pipe (16) upstream of the washing drum (18) and afterwards injected into the oxidation reactor via the line (6) is 1.6 t/h. The purged quantity of the hydrocarbon-containing cut (10) rich in disulphides is 1.8 t/h.

The flow entering the oxidation reactor, constituted by the soda to be regenerated, the excess of recirculated totally regenerated soda, and the hydrocarbon-containing cut has a flow rate of 15.0 t/h. In the washing section, the flow rate of partially regenerated soda (11) entering the washing section is 13.0 t/h.

Example 2

The process according to the invention is simulated according to the diagram described in FIG. 2.

An excess of recirculated soda (21*a*) of 9.1 t/h, constituted by the partially regenerated soda at 40° C., is sent into the circuit upstream of the oxidation reactor (4) via the pipe (21*a*) in order to control the rise in temperature in the oxidation reactor (4) and to obtain a temperature difference of 9° C. between the inlet and the outlet of the oxidation reactor.

The excess of recirculated soda (21*a*) is mixed with the flow which enters the oxidation reactor (4), constituted by used soda preheated in the exchanger (2) before the addition of air via the line (5) (0.2 t/h) and of catalyst (3). The product of mixing the flow (1*c*) and the excess of recirculated partially regenerated soda is introduced at 45° C. into the oxidation reactor (4), under the same pressure and temperature conditions as in Example 1.

The exchanger (2) serving to heat the used soda to a temperature of 45° C. at the inlet of the oxidation reactor (4) consumes 70 kW, and the exchanger (14) for cooling the partially regenerated soda, serving to cool it from 54° C. to 40° C., consumes 200 kW, as in Example 1. The flow rate of the hydrocarbon-containing cut injected via the pipe (16) upstream of the washing drum (18) and afterwards sent to the oxidation reactor via the line (6) is 0.5 t/h compared with 1.6 t/h in Example 1. The purged quantity of naphtha-type hydrocarbon (10) rich in disulphides is 0.7 t/h.

The flow rate of partially regenerated soda in the washing section (21*b*) is 3.9 t/h instead of 13 t/h in Example 1. Thus, the flow rate of partially regenerated soda to be treated in the washing section and the flow rate of associated naphtha-type hydrocarbon are reduced by 70% compared with Example 1, which accordingly reduces the size of the items of equipment of this section and reduces the inventory of soda and of catalyst of the unit.

The flow rate of soda and hydrocarbon circulating in the oxidation reactor and at the inlet of the decantation section is 13.9 t/h. Thus the flow rate circulating in this section is reduced by 7% compared with Example 1.

Example 3

The process according to the invention is simulated according to the variant described in FIG. 3.

The oxidation reactor (4) operates under the same pressure and temperature conditions as in Example 1.

The used soda (1*a*) is heated to 45° C. in the exchanger (2) before the addition of air via the line (5) (0.2 t/h) and of catalyst (3), then enters the oxidation reactor via the pipe (1*c*).

An excess of recirculated soda (22*a*) of 6.7 t/h, constituted by partially regenerated soda, is sent directly into the oxidation reactor in order to control the rise in temperature in the reactor and obtain a temperature difference of 9° C. between the inlet and the outlet of the oxidation reactor (4).

The exchanger (2) serving to heat the used soda to 45° C. consumes 23 kW and the exchanger for cooling (14) the partially regenerated soda, serving to cool it from 54° C. to 40° C., consumes 161 kW. The gain in utilities for the heat exchangers is 33% compared to the utilities consumed in Example 1.

The flow rate of the hydrocarbon-containing cut injected via the pipe (16) upstream of the washing drum (18) and afterwards sent to the oxidation reactor via the line (6) is 0.5 t/h, compared with 1.6 t/h in Example 1. The purged quantity of hydrocarbon-containing cut (10) rich in disulphides is 0.7 t/h.

The flow rate of soda and hydrocarbon circulating in the oxidation reactor and at the inlet of the separator drum (8) is 11.5 t/h. Thus the flow rate circulating in these sections is reduced by 23% compared with the flow rate of Example 1. The size of the items of equipment of these sections is therefore reduced by 23%, which reduces the inventory of catalyst and of alkaline solution of the unit.

In addition, the flow rate of partially regenerated soda in the washing section is 3.9 t/h instead of 13 t/h in Example 1. Thus, the flow rate of partially regenerated soda to be treated in the washing section and the associated flow rate of naphtha-type hydrocarbon are reduced by 70% compared with Example 1, which accordingly reduces the size of the items of equipment of this section.

Example 4

The process according to the invention in this variant is represented in FIG. 4.

An excess of soda, constituted by partially regenerated soda, recirculated via the pipe (22*a*) is set at 0.1 t/h.

The used soda is heated to 45° C. in an exchanger (2) before the addition of air via the line (5) (0.2 t/h) and of catalyst (3), then enters the oxidation reactor (4). The exchanger (2) consumes 23 kW. The oxidation reactor (4) operates under the same pressure and temperature conditions as in Example 1. The oxidation reactor is provided with a coil (23) situated in the oxidation reactor (4) and supplied with industrial water which makes it possible to cool the process fluid. This coil absorbs a quantity of heat of 99 kW.

The use of the coil (23) and the excess of recirculated soda (22*a*) make it possible to control the rise in temperature in the reactor and to obtain a difference of 9° C. between the inlet and the outlet of the reactor, as in the preceding examples.

The flow rate of the hydrocarbon-containing cut injected via the pipe (16) upstream of the washing drum (18) and afterwards sent to the oxidation reactor via the line (6) is 0.5 t/h compared with 1.6 t/h in Example 1. The purged quantity of the hydrocarbon-containing cut rich in disulphides (10) is 0.7 t/h.

The flow rate of soda and of hydrocarbon circulating in the oxidation reactor (4) and at the inlet of the separator drum (8) is 4.9 t/h. Thus the flow rate circulating in these sections is reduced by 67% compared with the flow rate of Example 1, and by 57% compared with the flow rate of Example 3. The size of the items of equipment of these sections is therefore reduced accordingly. The inventory of catalyst and of alkaline solution of the unit is reduced.

The exchanger for cooling the partially regenerated soda (14), serving to cool it from 54° C. to 40° C., consumes 61 kW.

The gain in utilities consumed in the heat exchangers of the unit is 33% compared to the utilities consumed in Example 1, and identical to that of Example 3.

In addition, the flow rate of partially regenerated soda in the washing section is 3.9 t/h instead of 13 t/h in Example 1. Thus, the flow rate of partially regenerated soda to be treated in the washing section and the associated flow rate of naphtha-type hydrocarbon are reduced by 70% compared with Example 1, which accordingly reduces the size of the items of equipment of this section.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 17/51.678, filed Mar. 1, 2017, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. Process for the regeneration of a used alkaline solution (1*a*) utilized in a unit for the extraction of the sulphur-containing compounds from a hydrocarbon-containing cut, comprising the following sequence of steps:

a) sending the used alkaline solution (1*a*) into an oxidation reactor (4) in which it is brought into contact with an oxidizing agent (5) and a catalyst (3), said used alkaline solution being heated to a temperature between 40° C. and 50° C. before being sent into the oxidation reactor (4), b) sending the effluents (7) of the oxidation reactor (4) into a separator (8) from which a hydrocarbon phase rich in disulphides (10), and a partially regenerated alkaline solution (11) are separated and extracted, c) cooling the partially regenerated alkaline solution (11) originating from step b) to a temperature less than or equal to 45° C., d) dividing the partially regenerated alkaline solution (15) cooled in step c) into two flows:

a flow constituting an excess of cooled partially regenerated alkaline solution which is recirculated and either sent upstream of (21*a*), or directly into (22*a*), the oxidation reactor (4), and which constitutes a cooling means used to control a rise in temperature of said oxidation reactor, and, a flow (21*b*) or (22*b*) which continues in the following steps of the regeneration process, e) mixing the flow (21*b*) or (22*b*), originating from step d), with a hydrocarbon-containing cut without sulphur-containing compounds (16), and f) sending the mixture originating from step e) into a separator (18) from which a totally regenerated alkaline solution (19), and a hydrocarbon-containing cut partially enriched with disulphides (6) are separated and extracted.

2. Process for the regeneration of a used alkaline solution according to claim 1, in which the excess (21*a*) of recirculated cooled partially regenerated alkaline solution is sent upstream of said oxidation reactor (4) and is introduced into said oxidation reactor (4) in a mixture with the used alkaline solution (1*a*).

3. Process for the regeneration of a used alkaline solution according to claim 1, in which the excess (22*a*) of recirculated cooled partially regenerated alkaline solution is sent to the oxidation reactor (4) directly to one or more points of said oxidation reactor (4).

4. Process for the regeneration of a used alkaline solution according to claim 3, in which the point or points of introduction of the excess of recirculated cooled partially regenerated alkaline solution into the oxidation reactor (4) are provided with a diffusion means or a mixing means.

5. Process for the regeneration of a used alkaline solution according to claim 3, in which the point or points of introduction of the excess of recirculated cooled partially regenerated alkaline solution into the oxidation reactor (4) are positioned so as to control a rise in temperature of the oxidation reactor (4).

6. Process for the regeneration of a used alkaline solution according to claim 1, in which the catalyst employed in the oxidation reactor (4) comprises cobalt or a vanadium phthalocyanine.

7. Process for the regeneration of a used alkaline solution according to claim 1, in which the catalyst employed in the oxidation reactor (4) is added to the used alkaline solution (1*a*) when sent into the oxidation reactor (4), so as to achieve a concentration of catalyst in the used alkaline solution between 10 and 1,000 ppm by weight.

8. Process for the regeneration of a used alkaline solution according to claim 1, in which the oxidation reactor (4) is equipped with an additional cooling means (23).

9. Process for the regeneration of a used alkaline solution according to claim 1, in which the excess of recirculated cooled partially regenerated alkaline solution (21*a*) or (22*a*) is cooled to a temperature at least 5° C. less than that of the cooled partially regenerated alkaline solution from step c), before being sent to the oxidation reactor (4).

10. Process for the regeneration of a used alkaline solution according to claim 1, in which the hydrocarbon-containing cut from which the sulphur-containing compounds are extracted to provide the used alkaline solution (1*a*) ranges from a methane cut to a kerosene cut.

11. Process for the regeneration of a used alkaline solution according to claim 1, in which the catalyst employed in the oxidation reactor (4) is added to the used alkaline solution (1*a*) when sent into the oxidation reactor (4), so as to achieve a concentration of catalyst in the used alkaline solution between 10 and 500 ppm by weight.

* * * * *